US007171354B1

(12) United States Patent
Yoshida et al.

(10) Patent No.: US 7,171,354 B1
(45) Date of Patent: Jan. 30, 2007

(54) AUDIO DECODER AND CODING ERROR COMPENSATING METHOD

(75) Inventors: Koji Yoshida, Yokohama (JP); Hiroyuki Ehara, Yokohama (JP); Masahiro Serizawa, Tokyo (JP); Kazunori Ozawa, Tokyo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 860 days.

(21) Appl. No.: 10/018,317

(22) PCT Filed: Jun. 30, 2000

(86) PCT No.: PCT/JP00/04323

§ 371 (c)(1),
(2), (4) Date: Dec. 18, 2001

(87) PCT Pub. No.: WO01/03115

PCT Pub. Date: Jan. 11, 2001

(30) Foreign Application Priority Data

Jun. 30, 1999 (JP) ..... 11/185712

(51) Int. Cl.
*G10L 19/04* (2006.01)

(52) U.S. Cl. ..... 704/219; 704/220

(58) Field of Classification Search ..... 704/219–225, 704/205–208

See application file for complete search history.

(56) References Cited

U.S. PATENT DOCUMENTS 5,495,555 A * 2/1996 Swaminathan ..... 704/207
5,657,418 A * 8/1997 Gerson et al. ..... 704/207

FOREIGN PATENT DOCUMENTS

| | | |
|---|---|---|
| EP | 0 673 018 A2 * | 9/1995 |
| EP | 0673018 | 9/1995 |
| EP | 0813183 | 12/1997 |
| JP | 08211895 | 8/1986 |
| JP | 04030200 | 2/1992 |
| JP | 05113798 | 5/1993 |
| JP | 06202696 | 7/1994 |
| JP | 07044200 | 2/1995 |
| JP | 07239699 | 9/1995 |
| JP | 08320700 | 12/1996 |
| JP | 09134198 | 5/1997 |
| JP | 09185396 | 7/1997 |

OTHER PUBLICATIONS

International Search Report dated Oct. 10, 2000.

(Continued)

*Primary Examiner*—Angela Armstrong
(74) *Attorney, Agent, or Firm*—Stevens, Davis, Miller & Mosher, LLP

(57) ABSTRACT

When an error is detected in coded data in the current frame, data separation section 201 separates the data into coding parameters first. Then, mode information decoding section 202 outputs decoding mode information in the previous frame and uses this as the mode information of the current frame. Furthermore, using the lag parameter code and gain parameter code of the current frame obtained at data separation section 201 and the mode information, lag parameter decoding section 204 and gain parameter decoding section 205 adaptively calculate a lag parameter and gain parameter to be used in the current frame according to the mode information.

5 Claims, 9 Drawing Sheets

OTHER PUBLICATIONS

International Telecommunication Union, G.729-Coding of Speech At 8KBIT/S Using Conjugate-Structure Algebraic-Code-Excited Linear-Prediction (CS-ACELP), Jul. 1995, pp. 38-40.

English translation of IPER form PCT/IB/338 dated Feb. 22, 2002.

Supplementary European Search Report dated Jul. 13, 2005.

* cited by examiner

AUDIO DECODER AND CODING ERROR COMPENSATING METHOD

TECHNICAL FIELD

The present invention relates to a speech decoder and code error compensation method used in a mobile communication system and speech recorder, etc. that encode and then transmit speech signals.

BACKGROUND ART

In the fields of digital mobile communications and speech storage, a speech coder is in use which compresses speech information and encodes compressed speech information at low bit rates for effective utilization of radio waves and storage media. In this case, when an error occurs in the transmission path (or recording media), the decoding side detects the error and uses an error compensation method to suppress deterioration in the quality of decoded speech.

Examples of such a conventional art include an error compensation method are described in a CS-ACELP coding system of the ITU-T Recommendation G.729 ("Coding of speech at 8 kbit/s using conjugate-structure algebraic-code-excited linear-prediction (CS-ACELP)").

FIG. 1 is a block diagram showing a configuration of a speech decoder including error compensation according to the CS-ACELP coding system. In FIG. 1, suppose speech is decoded in 10 ms-frame units (decoding units) and whether any error is detected or not in the transmission path is notified to the speech decoder in frame units.

First, the data received and coded in a frame in which no transmission path error has been detected is separated by data separation section 1 into parameters necessary for decoding. Then, using lag parameters decoded by lag parameter decoding section 2, adaptive excitation codebook 3 generates adaptive excitation and fixed excitation codebook 4 generates fixed excitation. Furthermore, using a gain decoded by gain parameter decoding section 5, multiplier 6 performs multiplications and adder 7 performs additions to generate an excitation. Furthermore, using LPC parameters decoded by LPC parameter decoding section 8, decoded speech is generated via LPC synthesis filter 9 and post filter 10.

On the other hand, with respect to the data received and coded in a frame in which some transmission path error has been detected, an adaptive excitation is generated using the lag parameter of the previous frame in which no error has been detected as a lag parameter, and a fixed excitation is generated by giving fixed excitation codebook 4 a random fixed excitation code and an excitation is generated using a value obtained by attenuating the adaptive excitation gain and fixed excitation gain of the previous frame as a gain parameter, and LPC synthesis and post filter processing are carried out using the LPC parameter of the previous frame as an LPC parameter to obtain decoded speech.

In the event of a transmission path error, the above-described speech decoder can perform error compensation processing in this way.

However, since the above-described conventional speech decoder carries out same compensation processing irrespective of speech characteristics (voiced or unvoiced, etc.) in a frame in which an error is detected and carries out error compensation primarily using only past parameters, there are limits to improvement of deterioration in the quality of decoded speech during error compensation.

DISCLOSURE OF INVENTION

It is an object of the present invention to provide a speech decoder and error compensation method capable of achieving further improved quality for decoded speech in a frame in which an error is detected.

A main subject of the present invention is to allow a speech coding parameter to include mode information which expresses features of each short segment (frame) of speech and allow the speech decoder to adaptively calculate lag parameters and gain parameters used for speech decoding according to the mode information.

Furthermore, another main subject of the present invention is to allow the speech decoder to adaptively control the ratio of adaptive excitation gain and fixed excitation gain according to the mode information.

A further main subject of the present invention is to adaptively control adaptive excitation gain parameters and fixed excitation gain parameters used for speech decoding according to values of decoded gain parameters in a normal decoding unit in which no error is detected, immediately after a decoding unit whose coded data is detected to contain an error.

BEST MODE FOR CARRYING OUT THE INVENTION

With reference now to the attached drawings, embodiments of the present invention will be explained in detail below.

Embodiment 1

Figure 1:
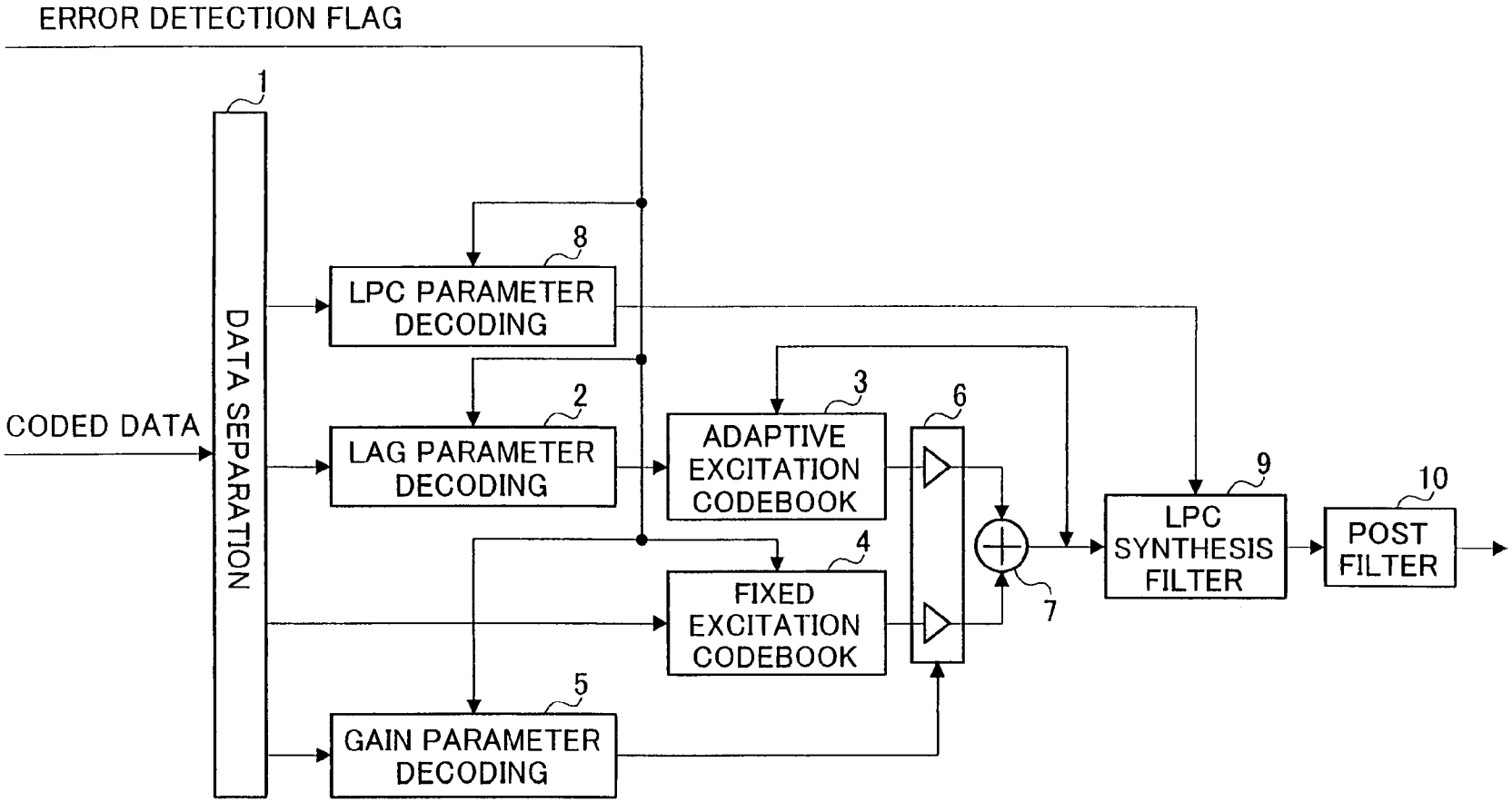
FIG. 1 PRIOR ART
FIG. 1 is a block diagram showing a configuration of a conventional speech decoder.
Figure 2:
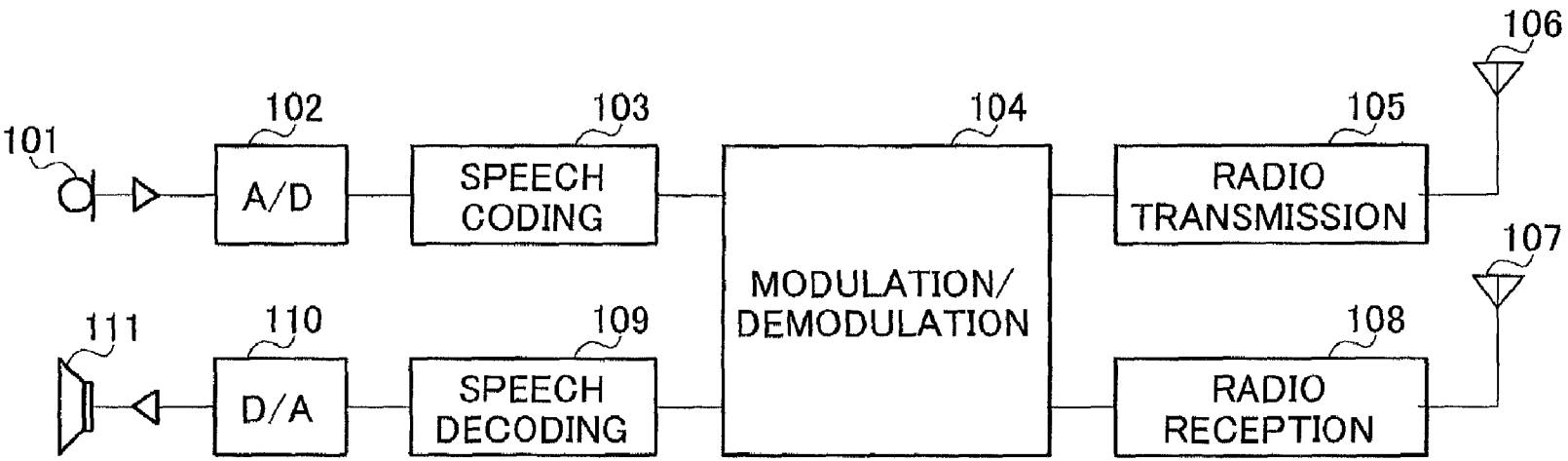
FIG. 2 is a block diagram showing a configuration of a radio communication system equipped with a speech coder and speech decoder according to an embodiment of the present invention.

FIG. 2 is a block diagram showing a configuration of a radio communication apparatus equipped with a speech decoder according to Embodiment 1 of the present invention. Here, the "radio communication apparatus" refers to a base station apparatus or a communication terminal such as a mobile station, etc. in a digital radio communication system.

In this radio communication apparatus, speech is converted to an electric analog signal by speech input apparatus 101 such as a microphone on the transmitting side and output to A/D converter 102. The analog speech signal is converted to a digital speech signal by A/D converter 102 and output to speech coding section 103. Speech coding section 103 carries out speech coding processing on the digital speech signal and outputs the coded information to modulation/demodulation section 104. Modulation/demodulation section 104 digitally modulates the coded speech signal and sends the modulated signal to radio transmission section 105. Radio transmission section 105 applies predetermined radio transmission processing to the modulated signal. This signal is sent via antenna 106.

On the other hand, on the receiving side of the radio communication apparatus, a reception signal received by antenna 107 is subjected to predetermined radio reception processing by radio reception section 108 and sent to modulation/demodulation section 104. Modulation/demodulation section 104 carries out demodulation processing on the reception signal and outputs the demodulated signal to speech decoding section 109. Speech decoding section 109 carries out decoding processing on the demodulated signal to obtain digital decoded speech signal and outputs the digital decoded speech signal to D/A converter 110. D/A converter 110 converts the digital decoded speech signal output from speech decoding section 109 to an analog decoded speech signal and outputs to speech output apparatus 111 such as a speaker. Finally, speech output apparatus 111 converts the electrical analog decoded speech signal to decoded speech and outputs.

Figure 3:
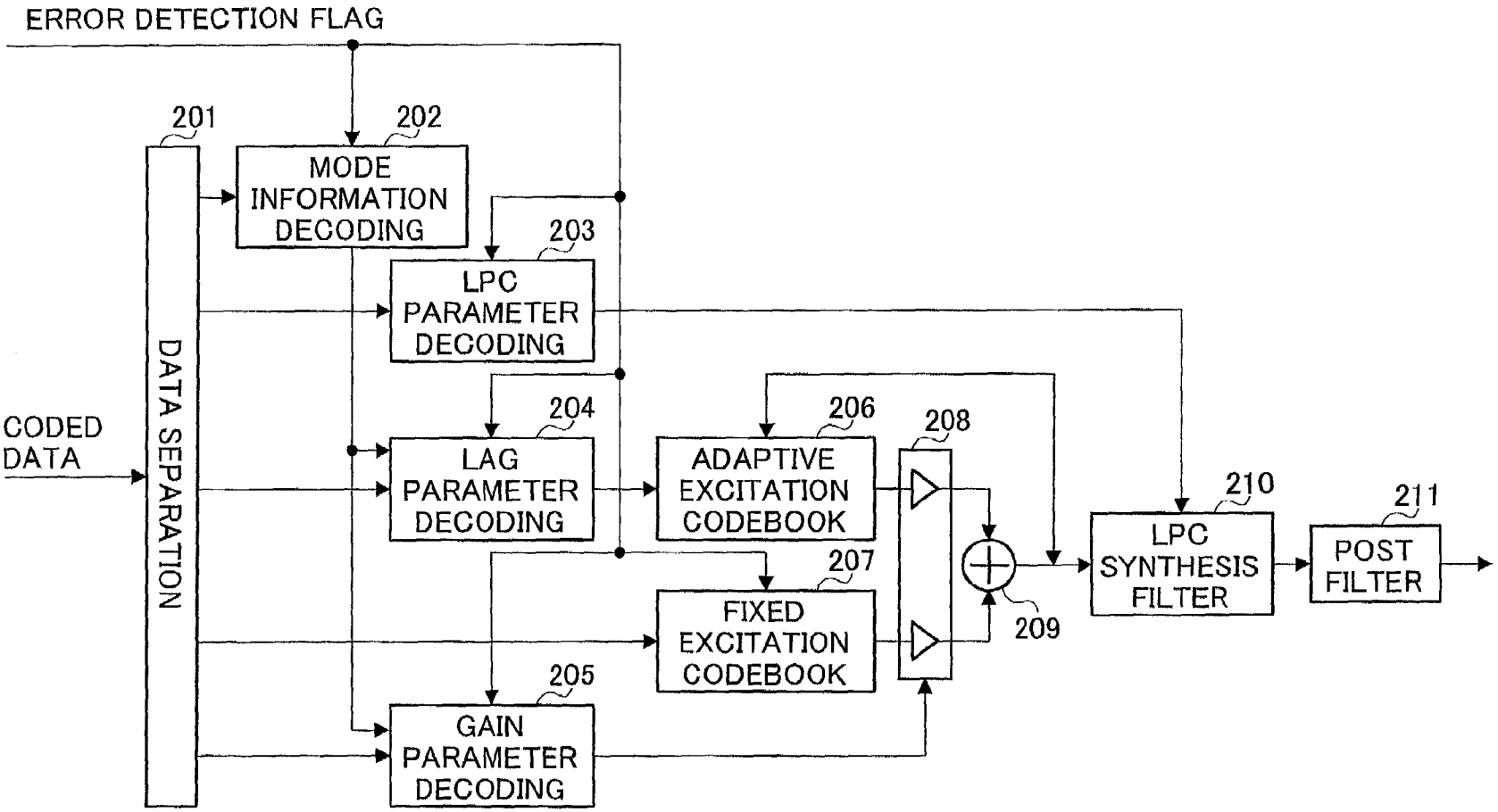
FIG. 3 is a block diagram showing a configuration of a speech decoder according to Embodiment 1 of the present invention.

FIG. 3 is a block diagram showing a configuration of a speech decoder according to Embodiment 1 of the present invention. The error compensation method in this speech decoder operates, when an error is detected on the speech decoding side from coded data obtained by the speech coding side coding an input speech signal, so as to suppress deterioration of the quality of decoded speech during speech decoding.

Here, speech is decoded in a certain short segment (called a "frame") on the order of 10 to 50 ms and the result of detection as to whether an error has occurred in reception data in the frame units or not is notified as an error detection flag. As the method of error detection, CRC (Cyclic Redundancy Check) or the like is normally used. Suppose error detection is performed outside this speech decoder beforehand. As data to be subjected to error detection, all coded data for every frame may be targeted or only perceptually important coded data may be targeted.

Furthermore, the speech coding system to which the error compensation method of the present invention is applied is targeted for those speech coding parameters (transmission parameters) including at least mode information expressing frame-specific features of a speech signal, a lag parameter expressing information on the pitch period of the speech signal or adaptive excitation, and gain parameter expressing gain information of the excitation signal or speech signal.

First, a case where no error is detected in coded data of a current frame subjected to speech decoding will be explained first. In this case, no error compensation operation is performed, but normal speech decoding is performed. In FIG. 3, data separation section 201 separates speech coding parameters from the coded data. Then, mode information decoding section 202, LPC parameter decoding section 203, lag parameter decoding section 204, and gain parameter decoding section 205 decode mode information, LPC parameter, lag parameter, and gain parameter, respectively.

Here, the mode information indicates a status of the speech signal in frame units and there are typically modes such as voiced, unvoiced and transient modes and the coding side carries out coding according to these statuses. For example, in the case of CELP coding in MPE (Multi Pulse Excitation) mode of the standard ISO/IEC 14496-3 (MPEG-4 Audio) which is standardized by the ISO/IEC, the coding side groups mode information under four modes such as unvoiced, transient, voiced (weak periodicity), and voiced (strong periodicity) according to the pitch predicted gain, and performs coding according to the mode.

The coding side then generates adaptive excitation signals according to lag parameters using adaptive excitation codebook 206 and generates fixed excitation signals according to fixed excitation codes using fixed excitation codebook 207. A gain is multiplied by multiplier 208 on each excitation signal generated using the decoded gain parameter and after two excitation signals are added up by adder 209, LPC synthesis filter 210 and post filter 211 generate and output a decoded signal.

On the other hand, when an error is detected in the coded data of the current frame, data separation section 201 separates the coded data into coding parameters first. Then, mode information decoding section 202 extracts the decoding mode information in the previous frame and uses this as the mode information of the current frame.

Furthermore, lag parameter decoding section 204 and gain parameter decoding section 205 adaptively calculate a lag parameter and gain parameter to be used for the current frame according to the mode information using the lag parameter code, gain parameter code and mode information of the current frame obtained by data separation section 201. This calculation method will be described in detail later.

Furthermore, though any method can be used to decode an LPC parameter and fixed excitation parameter, it is also possible to use the LPC parameter of the previous frame as an LPC parameter and a fixed excitation signal generated by giving a random fixed excitation code as a fixed excitation parameter as in the case of the conventional art. It is also possible to use any noise signal generated by a random number generator as a fixed excitation signal or use the same fixed excitation code separated from the coded data of the current frame as a fixed excitation parameter.

As in the case where no error is detected, decoded speech is generated from each parameter obtained in this way through generation of an excitation signal, LPC synthesis and the post filter.

Figure 4:
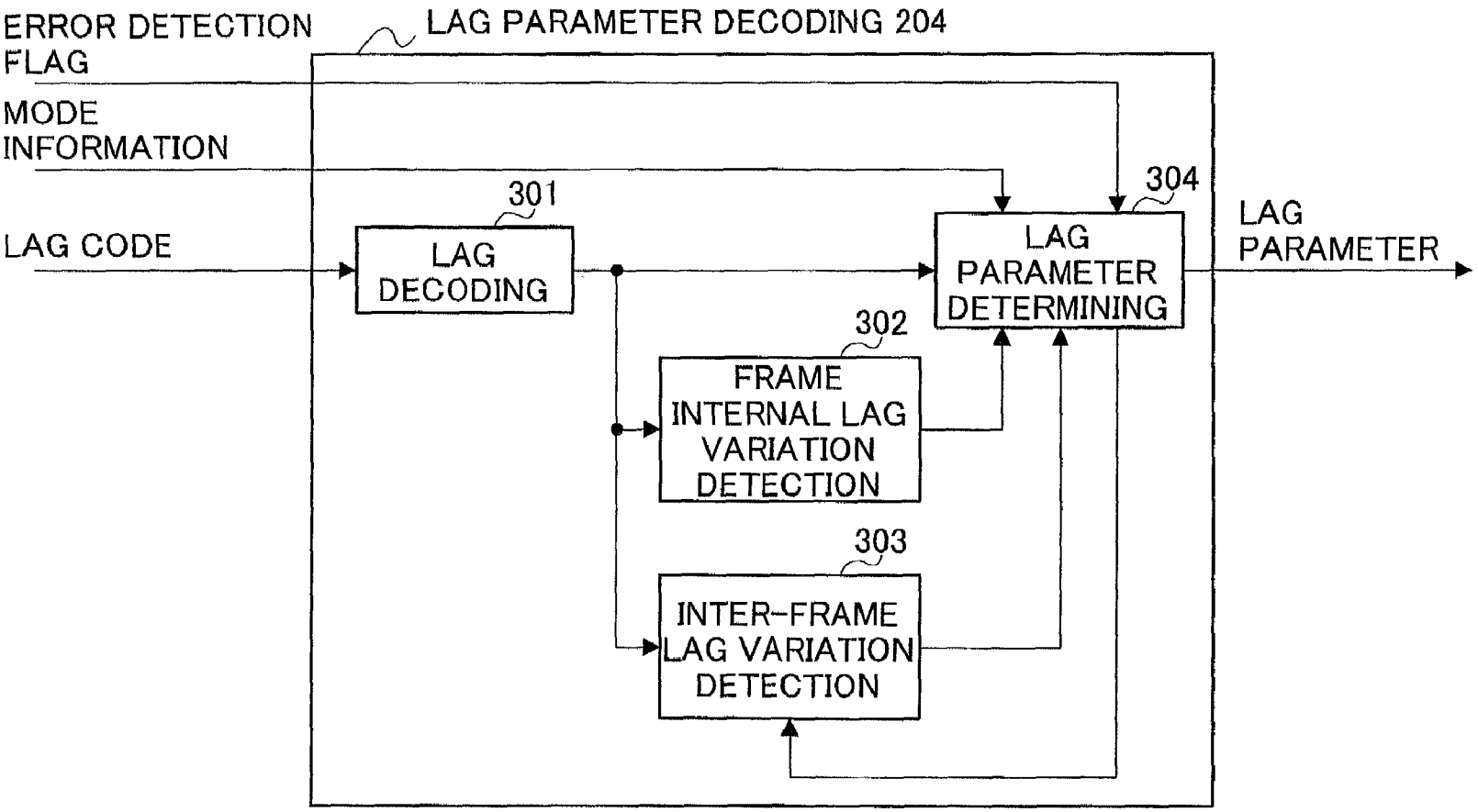
FIG. 4 is a block diagram showing an internal configuration of a lag parameter decoding section in the speech decoder according to Embodiment 1 of the present invention.

Next, the method of calculating a lag parameter to be used in the current frame when an error is detected will be explained using FIG. 4. FIG. 4 is a block diagram showing an internal configuration of lag parameter decoding section 204 in the speech decoder shown in FIG. 3.

In FIG. 4, the lag code of the current frame is decoded by lag decoding section 301 first. Then, frame internal lag variation detection section 302 and inter-frame lag variation detection section 303 measure decoding lag parameter variations in a frame and between frames.

Lag parameters corresponding to one frame consist of a plurality of lag parameters corresponding to a plurality of subframes in the one frame and a lag variation in the frame is detected by detecting whether there is any difference exceeding a certain threshold among the plurality of lag parameters. On the other hand, a lag variation between frames is detected by comparing a plurality of lag parameters in a frame with the lag parameter of the previous frame (last subframe) and detecting whether there is any difference exceeding a certain threshold. Then, lag parameter determining section 304 determines a lag parameter to be used definitively in the current frame.

Then, the method of determining this lag parameter will be explained.

First, if the mode information shows "voiced", the lag parameter used in the previous frame is unconditionally used as the value of the current frame. Then, if the mode information shows "unvoiced" or "transient", the parameter decoded from the coded data of the current frame is used on condition that constraints will be put on lag variations in a frame or between frames.

More specifically, as shown in an example under expression (1), if all variations of frame internal decoding lag parameter L(is) remain within a threshold, all those parameters are used as current frame lag parameter L'(is).

On the other hand, when the frame internal lag varies beyond the threshold, inter-frame lag variations are measured. According to the detection result of these inter-frame lag variations, lag parameter Lprev of the previous frame (or previous subframe) is used as a lag parameter of a subframe with a greater variation from the previous frame (or previous subframe) (difference exceeding the threshold), while lag parameters of a subframe with small variations are used as they are.

```
if |L(j+1)−L(j)| <Tha for all j=1~NS−2,
    L' (is) L (is) (is=0~NS−1)
Else                                    Expression(1)
    L' (is) L(is), if |L(is)−Lprev| <Thb
        Lprev otherwise
```

where, L(is) denotes a decoding lag parameter; L'(is), a lag parameter used in the current frame; NS, the number of subframes; Lprev, a lag parameter of the previous frame (or previous subframe); Tha and Thb; thresholds.

It is also possible to decide a lag parameter to be used for the current frame from information of only frame internal variations or information of only inter-frame variations using only frame internal lag variation detection section 302 or inter-frame lag variation detection section 303, respectively. It is also possible to apply the above-described processing only to the case where the mode information indicates "transient" and use the same lag parameter decoded from the coded data of the current frame in the case of "unvoiced".

The above explanation applies to the case where lag variation detection is performed on a lag parameter decoded from a lag code, but it is also possible to directly perform lag variation detection on a lag code value. A transient frame is a frame in which a lag parameter plays an important role as an onset of speech. Thus, in the above-described transient frame, it is possible to positively use decoding lag parameters obtained from the coded data of the current frame conditionally in such a way as to avoid deterioration due to coding errors. As a result, compared to the method using previous frame lag parameters unconditionally as in the case of the conventional art, it is possible to improve the quality of decoded speech.

Figure 5:
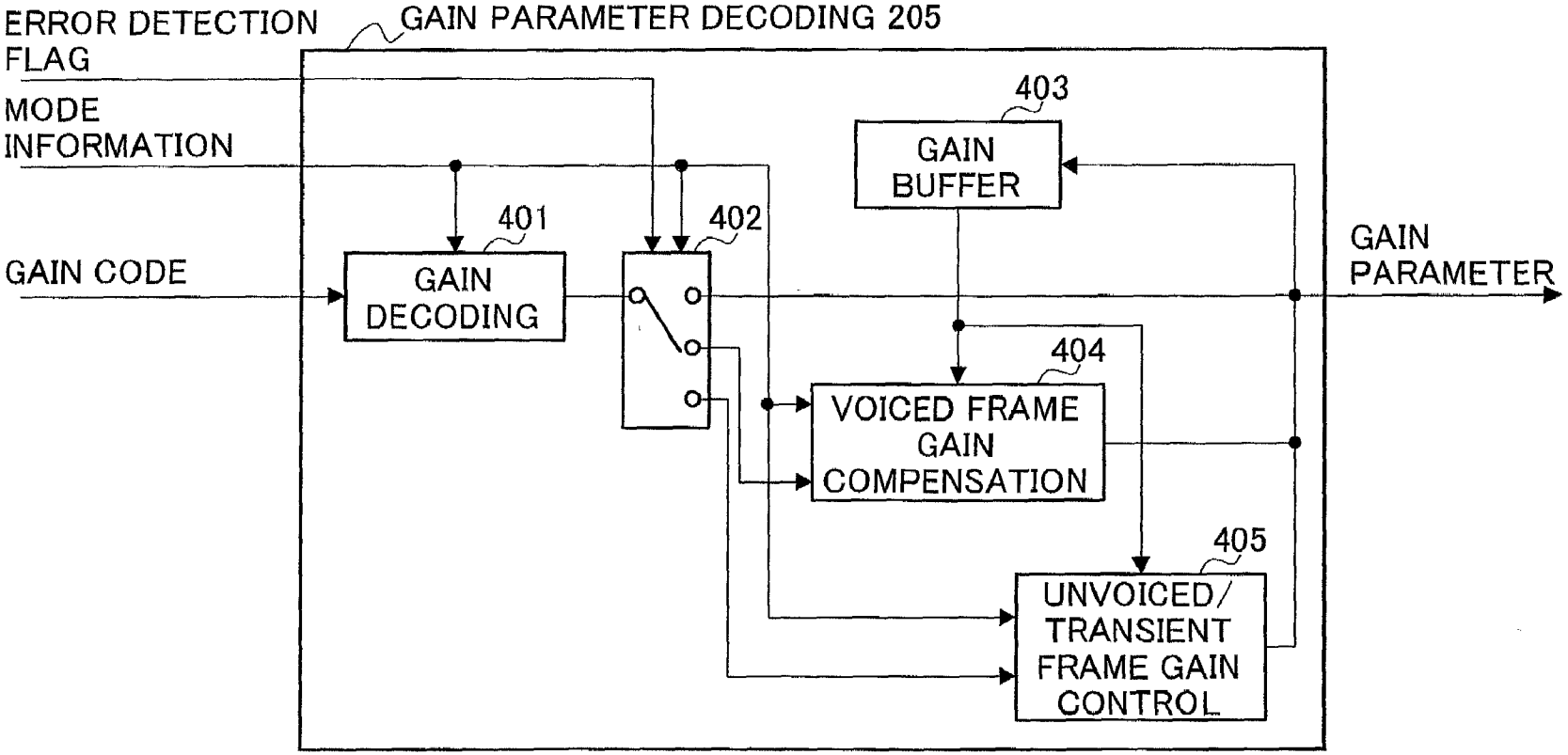
FIG. 5 is a block diagram showing an internal configuration of a gain parameter decoding section in the speech decoder according to Embodiment 1 of the present invention.

Then, the method of calculating gain parameters to be used in the current frame when an error is detected will be explained using FIG. 5. FIG. 5 is a block diagram showing an internal configuration of gain parameter decoding section 205 in the speech decoder shown in FIG. 3. In FIG. 5, gain decoding section 401 decodes a gain parameter from the current parameter code of the current frame.

In that case, when the gain decoding method varies depending on the mode information (e.g., the table used for decoding varies), decoding is performed according to the gain decoding method. As the mode information used in that case, the mode information decoded from the coded data of the current frame is used. However, as the method of expressing a gain parameter (coding method), if the method of expressing a gain value by combining a parameter that expresses power information of a frame (or subframe) and a parameter that expresses a correlation therewith (e.g., CELP coding in MPE mode of MPEG-4 Audio) is used, the value of the previous frame (or attenuated value of the previous frame) is used as the power information parameter.

Then, changeover section 402 changes processing according to the error detection flag and mode information. For frames in which no error is detected, a decoding gain parameter is output as is. On the other hand, for frames in which an error is detected, processing is changed according to the mode information.

First, when the mode information indicates "voiced", voiced frame gain compensation section 404 calculates a gain parameter to be used in the current frame. Any method may be used, but the gain parameter (adaptive excitation gain and fixed excitation gain) of the previous frame stored in gain buffer 403 attenuated by a certain value can also be used as in the case of the conventional example.

Then, in the case where the mode information indicates "transient" or "unvoiced", unvoiced/transient frame gain control section 405 performs gain value control using the gain parameter decoded by gain decoding section 401. More specifically, using the gain parameter of the previous frame obtained from gain buffer 403 as a reference, an upper limit and lower limit (or either one) from that reference value are provided and a decoding gain parameter limited by the upper limit (and lower limit) is used as the gain parameter of the current frame. Expression (2) below shows an example of the limitation method when the upper limit is set for the adaptive excitation gain and fixed excitation gain.

```
If Ga>Tha
   Ge ← Tha/Ga
   Ga ← Tha
If Ge<The*Ge_prev                    Expression (2)
   Ga ← (The8Ge_prev)/Ge
   Ge ← The*Ge_prev
```

where,

Ga: Adaptive excitation gain parameter

Ge: Fixed excitation gain parameter

Ge_prev: Fixed excitation gain parameter of previous subframe

Tha, The: Thresholds

As shown above, in a frame in which an error has been detected, in combination with the above-described lag parameter decoding section, the gain parameter code of the current frame that can contain some code errors is positively used conditionally in such a way as to avoid deterioration due to coding errors. This can improve the quality of decoded speech compared to the method unconditionally using the gain parameter of the previous frame as in the case of the conventional art.

As described above, during speech decoding in a frame whose coded data is detected to contain an error, the lag parameter decoding section and gain parameter decoding section adaptively calculate a lag parameter and gain parameter to be used for speech decoding according to the decoded mode information, and it is thereby possible to provide an error compensation method to achieve decoded speech of further improved quality.

More specifically, as a lag parameter to be used for speech decoding in the frame whose coded data is detected to contain an error, when the mode information of the current frame in the above-described lag parameter determining section indicates "transient", or "transient" or "unvoiced" and at the same time there are few variations in the decoding lag parameter in a frame or between frames, the decoding lag parameter decoded from the coded data of the current frame is used as the lag parameter of the current frame, and the past lag parameter is used as the current lag parameter under other conditions, and it is thereby possible to provide an error compensation method capable of improving the quality of decoded speech when the error-detected frame corresponds to an onset of the speech.

Furthermore, when an error is detected in the coded data of the current frame and at the same time the mode information indicates "transient" or "unvoiced", the above-described unvoiced/transient frame gain control section controls the gain to be output with an upper limit to an increase and/or a lower limit to a decrease from the past gain parameter specified with respect to the gain parameter decoded from the coded data of the current frame, and can thereby suppress the gain parameter decoded from the coded data that may possibly contain errors from taking an abnormal value due to the errors and provide an error compensation method capable of achieving further improved quality for decoded speech.

The error compensation method using the speech decoder shown in FIG. 3 above is targeted for a speech coding system including mode information that expresses features for every short segment of a speech signal as a coding parameter, while this error compensation method is also applicable to a speech coding system which does not include speech mode information in its coding parameters. In that case, the decoding side can be provided with a mode calculation section to calculate mode information to express features for every short segment of a speech signal from decoding parameters or decoding signals.

Moreover, the description of the speech decoder shown in FIG. 3 above refers to a so-called CELP (Code Excited Linear prediction) type in which an excitation is expressed as a sum of an adaptive excitation and fixed excitation and decoded speech is generated through an LPC synthesis, while the error compensation method of the present invention is widely applicable to any speech coding system that uses pitch period information, gain information of an excitation or speech signal as coding parameters.

Embodiment 2

Figure 6:
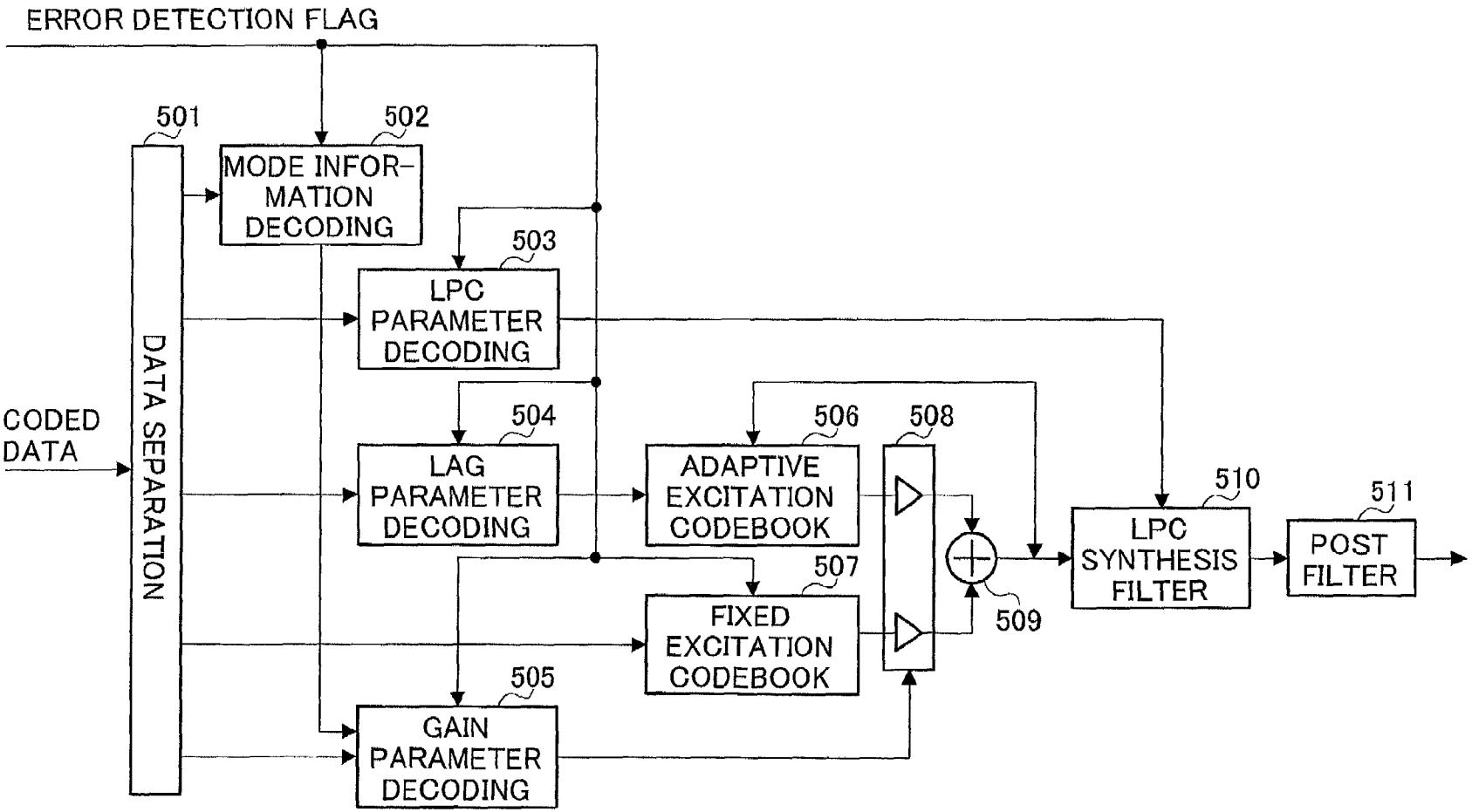
FIG. 6 is a block diagram showing a configuration of a speech decoder according to Embodiment 2 of the present invention.

FIG. 6 is a block diagram showing a configuration of a speech decoder according to Embodiment 2 of the present invention. As in the case of Embodiment 1, the error compensating method of the speech decoder of this embodiment operates, when the decoding side detects an error in coded data obtained by the speech coding side coding an input speech signal, in such a way as to suppress deterioration of the quality of the decoded speech during speech decoding by the speech decoder.

Here, speech decoding is performed in units of a predetermined short segment (called a "frame") on the order of 10 to 50 ms, and it is detected in frame units whether an error has occurred in the reception data or not and the detection result is notified as a detection flag.

Suppose error detection is carried out outside this speech decoder beforehand. As data to be subjected to error detection, all coded data for every frame may be targeted or only perceptually important coded data may be targeted. Furthermore, the speech coding system to which the error compensation method of the present invention is applied is targeted for those speech coding parameters (transmission parameters) including at least mode information expressing frame-specific features of a speech signal, gain parameter expressing gain information of an adaptive excitation signal and fixed excitation signal.

The case where no error is detected in the coded data of the frame (current frame) to be subjected to speech decoding is the same as Embodiment 1 above and explanations thereof will be omitted.

When an error is detected in the coded data of the current frame, data separation section 501 separates the coded data into coding parameters first. Then, mode information decoding section 502 outputs the decoding mode information in the previous frame and uses this as the mode information of the current frame. This mode information is sent to gain parameter decoding section 505.

Furthermore, lag parameter decoding section 504 decodes lag parameters to be used for the current frame. Any method can be used to decode parameters, but as in the case of the conventional art, it is also possible to use the lag parameter of the previous frame in which no error has been detected. Then, gain parameter decoding section 505 calculates a gain parameter using mode information using a method which will be described later.

Furthermore, any method can be used to decode LPC parameters and fixed excitation parameters, but as in the case of the conventional art, it is also possible to use the LPC parameter of the previous frame as an LPC parameter and a fixed excitation signal generated by giving a random fixed excitation code as a fixed excitation parameter. It is also possible to use any noise signal generated by a random number generator as a fixed excitation signal. Furthermore, it is also possible to perform decoding using the same fixed excitation code obtained by separating it from the coded data of the current frame as a fixed excitation parameter. As in the case where no error is detected, decoded speech is generated from each parameter obtained in this way through generation of an excitation signal, LPC synthesis and the post filter.

Figure 7:
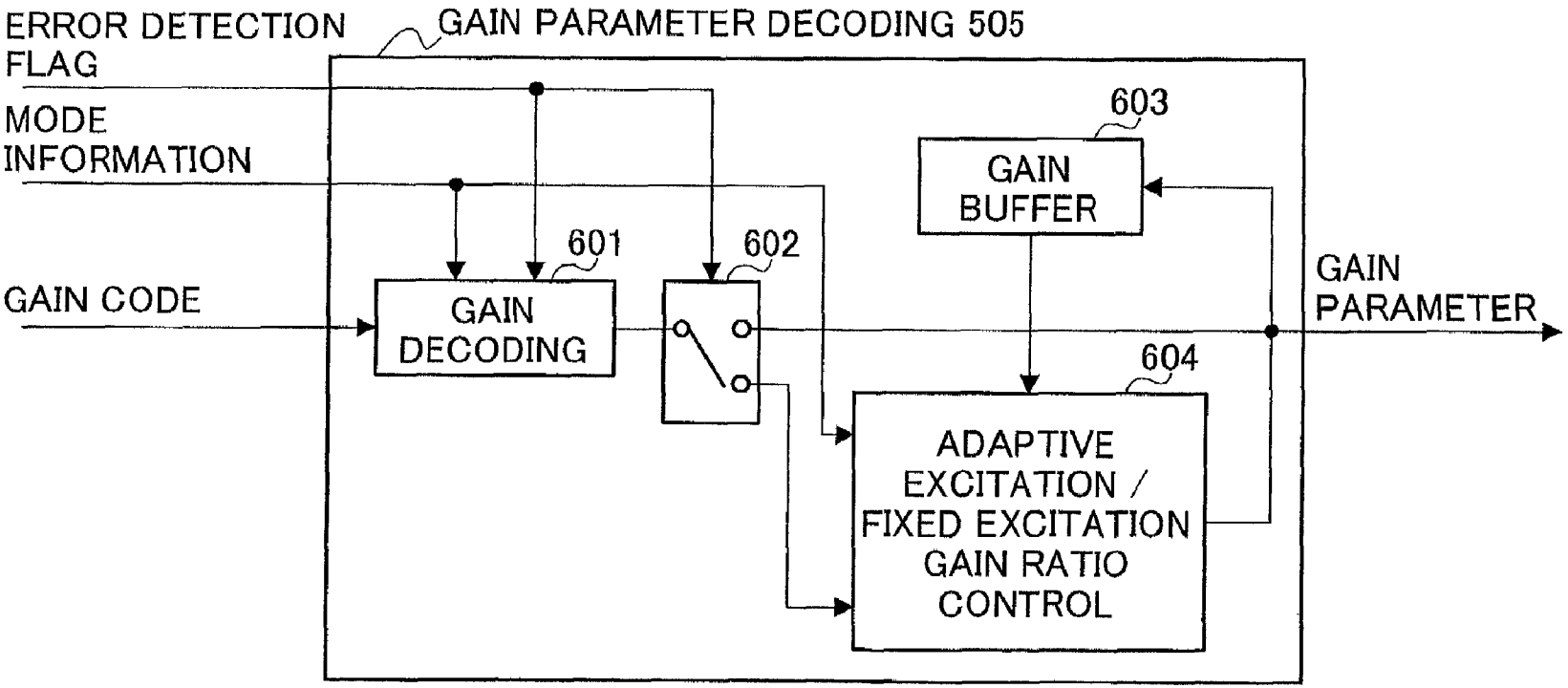
FIG. 7 is a block diagram showing an internal configuration of a gain parameter decoding section in the speech decoder according to Embodiment 2 of the present invention.

Next, the method of calculating gain parameters to be used in the current frame when an error is detected will be explained using FIG. 7. FIG. 7 is a block diagram showing an internal configuration of gain parameter decoding section 505 in the speech decoder shown in FIG. 6.

In FIG. 7, gain decoding section 601 decodes a gain parameter from the current parameter code of the current frame first. In that case, when the gain decoding method varies depending on the mode information (e.g., the table used for decoding varies, etc.), decoding is performed according to the gain decoding method. Then, changeover section 602 changes processing according to the error detection flag. For frames in which no error is detected, a decoded gain parameter is output as is.

On the other hand, for frames in which an error has been detected, adaptive excitation/fixed excitation gain ratio control section 604 carries out control of the adaptive excitation/fixed excitation gain ratio over the gain parameter (adaptive excitation gain and fixed excitation gain) of the previous frame stored in gain buffer 603 according to the mode information and outputs the gain parameter. More specifically, control is performed so as to increase the ratio of the adaptive excitation gain when the mode information of the current frame shows "voiced" and decrease the ratio of the adaptive excitation gain when the mode information of the current frame shows "transient" or "unvoiced".

However, the ratio is controlled so that the power of the excitation input to the LPC synthesis filter which adds up the adaptive excitation and fixed excitation is equivalent to the power before the ratio control. In the case where error detection frames appear consecutively (also including one-time appearance), it is desirable to perform such control that attenuates the power of the excitation together.

It is also possible, instead of providing gain buffer 603, to provide a gain code buffer for storing past gain codes, for gain decoding section 601 to decode the gain using the gain code of the previous frame for a frame in which an error is detected and perform adaptive excitation/fixed excitation gain ratio control over the decoded gain.

Thus, in the case where the current frame subjected to error compensation is "voiced", by making the adaptive excitation component predominant, thereby making the voiced mode stationary, while making the fixed excitation component predominant in the unvoiced/transmit mode, it is possible to suppress deterioration by an inappropriate periodic component by the adaptive excitation and thereby improve the perceptual quality.

As described above, during speech decoding in a frame whose decoded data is detected to contain an error, the adaptive excitation/fixed excitation gain ratio control section performs adaptive excitation/fixed excitation gain ratio control over the gain parameter (adaptive excitation gain and fixed excitation gain) of the previous frame according to the mode information, and can thereby provide an error compensation method that attains further improved quality for decoded speech.

The speech decoder shown in FIG. 6 above is described as being targeted for a speech coding system including the mode information expressing features of every short segment of a speech signal as a coding parameter, but the error compensation method of the present invention is also applicable to a speech coding system whose coding parameter does not contain the mode information of speech. In that case, it is possible to include a mode calculation section for calculating mode information expressing features of every short segment of a speech signal from the decoding parameter or decoding signal on the decoding side.

Embodiment 3

Figure 8:
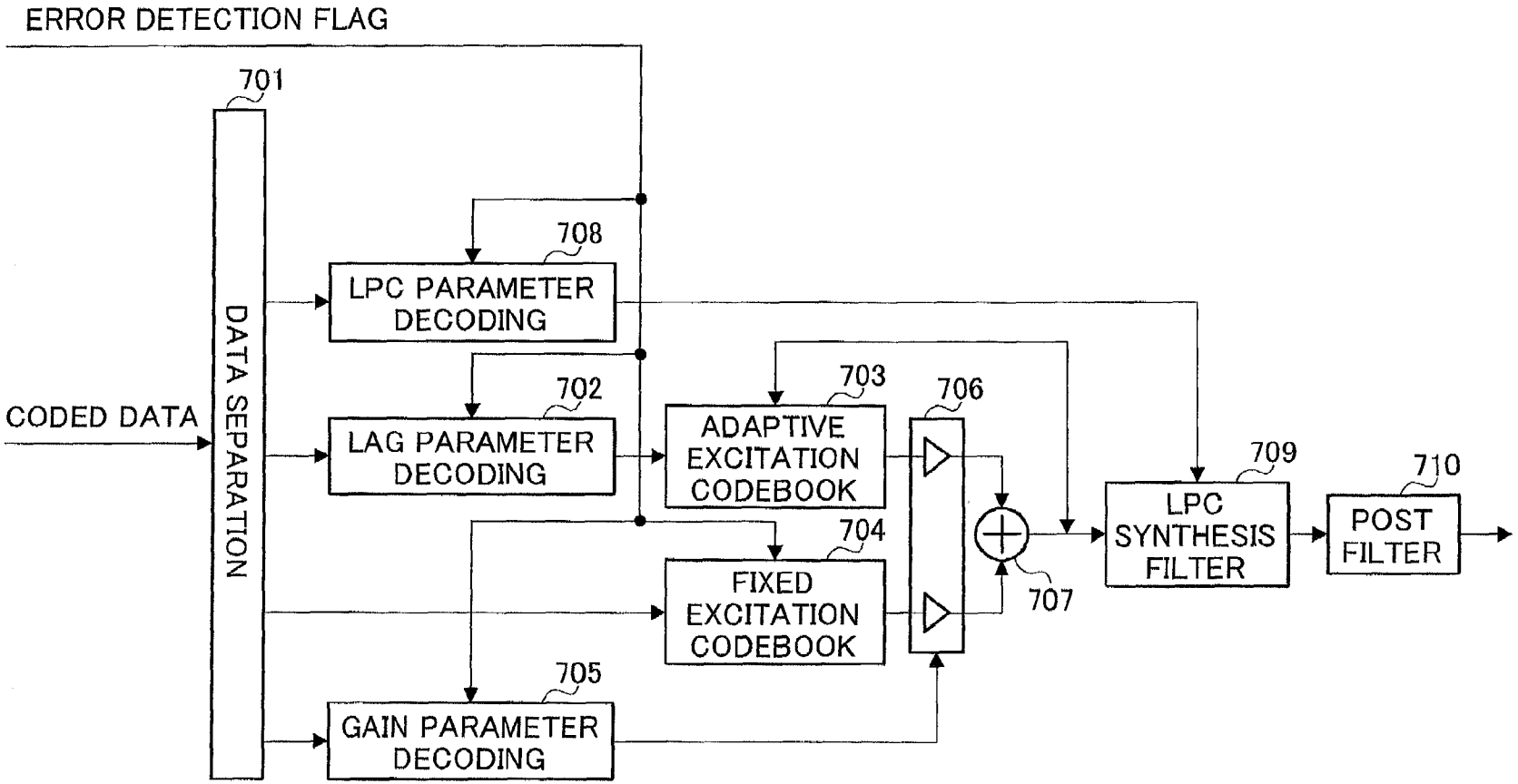
FIG. 8 is a block diagram showing a configuration of a speech decoder according to Embodiment 3 of the present invention.

FIG. 8 is a block diagram showing a configuration of a speech decoder according to Embodiment 3 of the present invention. As in the case of Embodiments 1 and 2, the error compensating method of the speech decoder of this embodiment operates, when the decoding side detects an error in coded data obtained by the speech coding side coding an input speech signal, in such a way as to suppress deterioration of the quality of the decoded speech during speech decoding by the speech decoder.

Here, speech decoding is performed in units of a predetermined short segment (called a "frame") on the order of 10 to 50 ms, and it is detected in frame units whether an error has occurred in the reception data or not and the detection result is notified as a detection flag. Suppose error detection is carried out outside this speech decoder beforehand. As data to be subjected to error detection, all coded data for every frame may be targeted or only perceptually important coded data may be targeted.

Furthermore, the speech coding system to which the error compensation method of the present invention is applied is targeted for those speech coding parameters (transmission parameters) including at least a gain parameter expressing gain information of an adaptive excitation code signal and fixed excitation code signal.

In a frame in which no transmission path error is detected, data separation section 701 separates the coded data into parameters necessary for decoding first. Then, using the lag parameter decoded by lag parameter decoding section 702, adaptive excitation codebook 703 generates an adaptive excitation and fixed excitation codebook 704 generates a fixed excitation.

Furthermore, using the gain decoded by gain parameter decoding section 705 using the method which will be described later, an excitation is generated through a multiplication and addition of gains by multiplier 706 and adder 707. Then, decoded speech is generated via LPC synthesis filter 709 and post filter 710 using these excitation and the LPC parameter decoded by LPC parameter decoding section 708.

On the other hand, for frames in which some transmission path error is detected, each decoding parameter is generated, and then decoded speech is generated in the same way as for frames in which no error is detected. Any method can be used to decode parameters except gain parameters, but as in the case of the conventional art, it is also possible to use the parameter of the previous frame as the LPC parameter and lag parameter.

Furthermore, it is also possible to perform decoding using a fixed excitation signal generated by giving a random fixed excitation code as a fixed excitation parameter, using an arbitrary noise signal generated by a random number generator as a fixed excitation signal, or using the same fixed excitation code separated from the coded data of the current frame as a fixed excitation parameter, etc.

Figure 9:
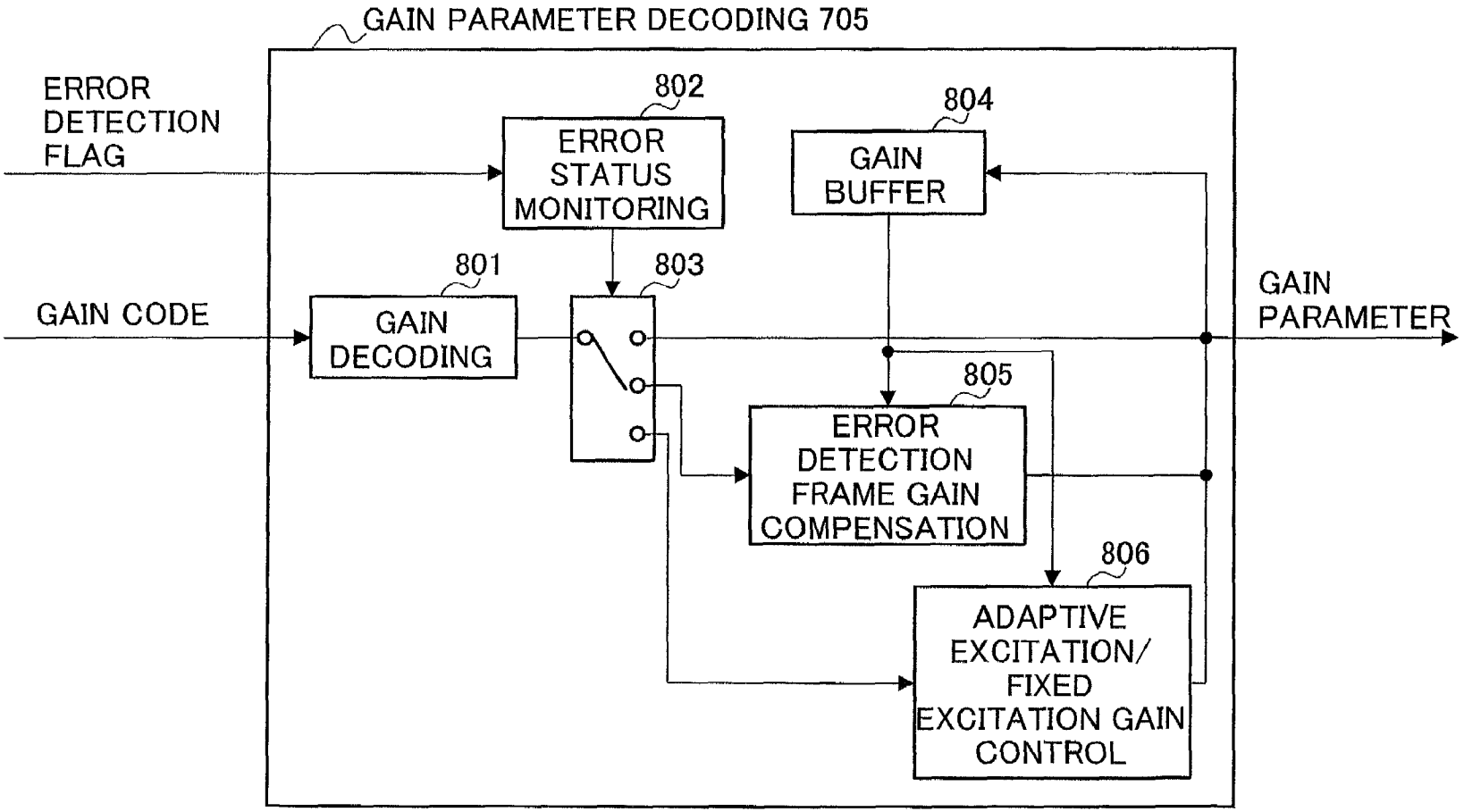
FIG. 9 is a block diagram showing an internal configuration of a gain parameter decoding section in the speech decoder according to Embodiment 3 of the present invention.

Next, the method of decoding gain parameters by the gain parameter decoding section will be explained using FIG. 9. FIG. 9 is a block diagram showing an internal configuration of gain parameter decoding section 705 in the speech decoder shown in FIG. 8. In FIG. 9, the gain parameter is decoded by gain decoding section 801 from the current parameter code of the current frame first. Furthermore, error status monitoring section 802 decides the status of error detection according to whether an error is detected or not. This status corresponds to the current frame in any one of the following cases:

Status 1) Error-detected frame

Status 2) Consecutive (including the case of one time continuation) normal (no error is detected) frames immediately after an error-detected frame Status 3) Other frames in which no error is detected Then, changeover section 803 changes processing according to above-described status. In the case of status 3), a gain parameter decoded by gain decoding section 801 is output as is.

Then, in the case of status 1), a gain parameter in the error-detected frame is calculated. Any method can be used to calculate the gain parameter and it is also possible to use a value obtained by attenuating the adaptive excitation gain and fixed excitation gain of the previous frame as in the case of the conventional art. It is also possible to carry out decoding using the gain code of the previous frame and use it as the gain parameter of the current frame. It is further possible, as shown in Embodiment 1 or 2, to use lag gain parameter control according to the mode and gain parameter ratio control according to the mode.

Then, in status 2), adaptive excitation/fixed excitation gain control section 806 carries out the following processing on a normal frame after the error detection. First, of the gain parameters decoded by gain decoding section 801, the value of the adaptive excitation gain (coefficient value multiplied on the adaptive excitation) is subjected to control with an upper value specified. More specifically, it is possible to specify a fixed value (e.g., 1.0) as the upper limit, decide an upper limit that is proportional to the decoded adaptive excitation gain value or combine them. Furthermore, together with the above-described adaptive excitation gain upper value control, the fixed excitation gain is also controlled simultaneously in such a way as to correctly maintain the ratio of the adaptive excitation gain to the fixed excitation gain. An example of a specific implementation method is shown in expression (3) below.

For a certain number of first subframes in status 2),

```
if Ga > 1.0
   Ge ← (1.0/Ga)*Ge
   Ga ← 1.0
```

For subframes exceeding the above case in status 2) Expression (3)

```
if Ga > 1.0
   Ge ← {((Ga+1.0)/2)/Ga}*Ge
   Ga ← (Ga+1.0)/2
```

where,

Ga: Adaptive excitation gain

Ge: Fixed excitation gain

When a method of expressing a gain value using a combination of a parameter expressing frame (or subframe) power information and a parameter expressing a correlation therewith (e.g., CELP coding in MPE mode of MPEG-4 Audio) is adopted as the method of expressing a gain parameter (coding method), an adaptive excitation gain is decoded depending on the decoded excitation of the previous frame, and therefore in the case of a normal frame after error detection, the adaptive excitation gain is different from the original value because of the error compensation processing of the previous frame and its quality may sometimes deteriorate due to an abnormal amplitude expansion of the decoded speech. However, quality deterioration can be suppressed by limitation of gain with the upper limit in this embodiment.

Furthermore, by controlling the ratio of adaptive excitation gain to fixed excitation gain so that this ratio becomes the value with the original decoding gain without errors, the excitation signal in the normal frame after error detection becomes more similar to an excitation in the case of no error, thus making it possible to improve the quality of decoded speech.

The coding error compensation methods in above-described Embodiments 1 to 3 can also be configured by software. For example, it is possible to store the program of the above-described error compensation method in a ROM and construct a system so as to operate under instructions from the CPU according to the program. Or it is also possible to store the program, adaptive excitation codebook, and fixed excitation codebook in a computer-readable storage medium and store the program, adaptive excitation codebook, and fixed excitation codebook of this storage medium in a RAM of the computer and operate the system according to the program. These cases also show the same actions and effects as in above-described Embodiments 1 to 3.

The speech decoder of the present invention adopts a configuration comprising receiving means for receiving data containing coded transmission parameters including mode information, lag parameter and gain parameter, a decoding section for decoding the above-described mode information, lag parameter and gain parameter, and a determining section for using mode information corresponding to a decoding unit earlier than the decoding unit corresponding to the above-described data in which an error is detected and adaptively determining a lag parameter and gain parameter to be used for the above-described decoding unit.

According to this configuration, when speech is decoded in the decoding unit whose coded data is detected to contain an error, a lag parameter and gain parameter to be used for speech decoding are adaptively calculated according to the decoded mode information, and it is thereby possible to provide further improved quality for decoded speech.

The speech decoder of the present invention in the above-described configuration also adopts a configuration wherein the determining section comprises a detection section for detecting variations within a lag parameter decoding unit and/or between lag parameter decoding units and determines a lag parameter to be used in the above-described decoding unit according to the detection result of the above-described detection section and the above-described mode information.

According to this configuration, when speech is decoded in the decoding unit whose coded data is detected to contain an error, a lag parameter to be used for speech decoding is adaptively calculated according to the decoded mode information and the results of detection of variations within a decoding unit and/or between decoding units, and it is thereby possible to provide further improved quality for decoded speech.

The speech decoder of the present invention in the above-described configuration also adopts a configuration wherein the above-described lag parameter corresponding to the decoding unit is used when the mode indicated by the mode information is a transient mode or unvoiced mode and when the detection section detects no variations exceeding a predetermined amount within a lag parameter decoding unit and/or between lag parameter decoding units, and the lag parameter corresponding to a past decoding unit is used in other cases.

According to this configuration, it is possible to improve the quality of decoded speech especially when the error detection decoding unit corresponds to an onset of speech.

The speech decoder of the present invention in the above-described configuration also adopts a configuration wherein when the mode indicated by the mode information is a transient mode or unvoiced mode, the determining section comprises a restriction control section for putting restrictions on the range of gain parameters according to gain parameters corresponding to a past decoding unit and determines a gain parameter subjected to the range restrictions as the gain parameter.

According to this configuration, when an error is detected in coded data of the current decoding unit and at the same time the mode information indicates a transient or unvoiced mode, the output gain is controlled by specifying an upper limit to an increase and/or lower limit to a decrease from the past gain parameter, thereby making it possible to suppress the gain parameter decoded from the coded data that can contain an error from taking an abnormal value due to the error and provide further improved quality for decoded speech.

The speech decoder of the present invention adopts a configuration comprising a reception section for receiving data containing coded transmission parameters including mode information, lag parameter, fixed excitation parameter and gain parameter made up of an adaptive excitation gain and fixed excitation gain, a decoding section for decoding the above-described mode information, lag parameter, fixed excitation parameter and gain parameter, and a ratio control section for controlling the ratio of the adaptive excitation gain to the fixed excitation gain using mode information corresponding to a decoding unit earlier than the decoding unit whose data is detected to contain an error.

The speech decoder of the present invention in the above-described configuration also adopts a configuration wherein the above-described ratio control section controls the gain ratio in such a way as to increase the ratio of the adaptive excitation gain when the mode information is a voiced mode and decrease the ratio of the adaptive excitation gain when the mode information is a transient mode or unvoiced mode.

According to these configurations, when a gain parameter is decoded in the decoding unit whose coded data is detected to contain an error, the ratio of the adaptive excitation gain to the fixed excitation gain is adaptively controlled according to the mode information, making it possible to further perceptually improve the quality of decoded speech in error detection decoding units.

The speech decoder of the present invention adopts a configuration comprising a reception section for receiving data containing coded transmission parameters including a lag parameter, fixed excitation parameter and gain parameter made up of an adaptive excitation gain and fixed excitation gain, a decoding section for decoding the above-described lag parameter, fixed excitation parameter and gain parameter, and a specifying section for specifying an upper limit of the gain parameter in a normal decoding unit immediately after the decoding unit in which an error is detected.

According to this configuration, in a normal decoding unit with no errors detected immediately after the decoding unit whose coded data is detected to contain an error, control is performed so as to specify the upper limit of the decoded adaptive excitation gain parameter, thereby making it possible to suppress deterioration of the quality of decoded speech due to an abnormal amplitude expansion of the decoded speech signal in the normal decoding unit immediately after the error detection.

The speech decoder of the present invention in the above-described configuration also adopts a configuration wherein the above-described specifying section controls the fixed excitation gain so as to maintain a predetermined ratio with respect to the adaptive excitation gain within a range whose upper limit is specified.

According to this configuration, since the ratio between the adaptive excitation gain and fixed excitation gain is controlled to take a value with an original decoding gain without errors, the excitation signal in the normal decoding unit immediately after the error detection becomes more similar to the case with no errors, and it is thereby possible to improve the quality of decoded speech.

The speech decoder of the present invention adopts a configuration comprising a reception section for receiving data containing coded transmission parameters including a lag parameter and gain parameter, a decoding section for decoding the above-described lag parameter and gain parameter, a mode calculation section for calculating mode information from a decoding parameter or decoding signal obtained by decoding the above-described data, and a determining section for using mode information corresponding to a decoding unit earlier than the decoding unit corresponding to the above-described data in which an error is detected and adaptively determining a lag parameter and gain parameter to be used for the above-described decoding unit.

According to this configuration, it is possible to adaptively calculate a lag parameter and gain parameter to be used for speech decoding even for the speech coding system whose coding parameter includes no speech mode information according to the mode information calculated on the decoding side, and thereby provide further improved quality for decoded speech.

The speech decoder of the present invention adopts a configuration comprising a reception section for receiving data containing coded transmission parameters including a lag parameter, fixed excitation parameter and gain parameter made up of an adaptive excitation gain and fixed excitation gain, a decoding section for decoding the above-described lag parameter, fixed excitation parameter and gain parameter, a mode calculation section for calculating mode information from a decoding parameter or decoding signal obtained by decoding the above-described data, and a ratio control section for controlling the ratio of the adaptive excitation gain to the fixed excitation gain using mode information corresponding to a decoding unit earlier than the decoding unit whose data is detected to contain an error.

According to this configuration, when a gain parameter is decoded in the decoding unit whose coded data is detected to contain an error, the ratio of the adaptive excitation gain to the fixed excitation gain is adaptively controlled according to the mode information calculated on the decoding side even for the speech coding system whose coding parameter includes no speech mode information, making it possible to further perceptually improve the quality of decoded speech in error detection decoding units.

The code error compensation method of the present invention comprises a step of decoding mode information, lag parameter and gain parameter in data containing coded transmission parameters including the mode information, lag parameter and gain parameter, and a determining step of using mode information corresponding to a decoding unit earlier than the decoding unit corresponding to the above-described data in which an error is detected and adaptively determining a lag parameter and gain parameter to be used for the above-described decoding unit.

According to this method, when speech is decoded in the decoding unit whose coded data is detected to contain an error, a lag parameter and gain parameter to be used for speech decoding are adaptively calculated according to the decoded mode information, and it is thereby possible to provide further improved quality for decoded speech.

The code error compensation method of the present invention in the above-described method also comprises a step of detecting variations within a lag parameter decoding unit and/or between lag parameter decoding units and determines a lag parameter to be used in the above-described decoding unit according to the detection result and the mode information.

According to this method, when speech is decoded in the decoding unit whose coded data is detected to contain an error, a lag parameter to be used for speech decoding is adaptively calculated according to the decoded mode information and the results of detection of variations within a decoding unit and/or between decoding units, and it is thereby possible to provide further improved quality for decoded speech.

The code error compensation method of the present invention in the above-described method also uses the above-described lag parameter with respect to the decoding unit when the mode indicated by the mode information is a transient mode or unvoiced mode and when no variations exceeding a predetermined amount within a lag parameter decoding unit and/or between lag parameter decoding units are detected, and uses the lag parameter corresponding to a past decoding unit in other cases.

According to this method, it is possible to improve the quality of decoded speech especially when the error detection decoding unit corresponds to an onset of speech.

The code error compensation method of the present invention in the above-described method puts restrictions on the range of gain parameters according to gain parameters corresponding to a past decoding unit and determines a gain parameter subjected to the range restrictions as the gain parameter when the mode indicated by the mode information is a transient mode or unvoiced mode.

According to this method, when an error is detected in coded data of the current decoding unit and at the same time the mode information indicates a transient or unvoiced mode, the output gain is controlled for the gain parameter decoded from the coded data of the current decoding unit by specifying an upper limit to an increase and/or lower limit to a decrease from the past gain parameter, thereby making it possible to suppress the gain parameter decoded from the coded data that can contain an error from taking an abnormal value due to the error and provide further improved quality for decoded speech.

The code error compensation method of the present invention comprises a step of receiving data containing coded transmission parameters including mode information, lag parameter, fixed excitation parameter and gain parameter made up of an adaptive excitation gain and fixed excitation gain, a step of decoding the above-described mode information, lag parameter, fixed excitation parameter and gain parameter, and a step of controlling the ratio of the adaptive excitation gain to the fixed excitation gain using mode information corresponding to a decoding unit earlier than the decoding unit whose data is detected to contain an error.

The code error compensation method of the present invention in the above-described method controls the gain ratio in such a way as to increase the ratio of the adaptive excitation gain when the mode indicated by the mode information is a voiced mode and decrease the ratio of the adaptive excitation gain when the mode indicated by the mode information is a transient mode or unvoiced mode.

According to these methods, when a gain parameter is decoded in the decoding unit whose coded data is detected to contain an error, the ratio of the adaptive excitation gain to the fixed excitation gain is adaptively controlled according to the mode information, making it possible to further perceptually improve the quality of decoded speech in error detection decoding units according to the mode information.

The code error compensation method of the present invention comprises a step of receiving data containing coded transmission parameters including a lag parameter, fixed excitation parameter and gain parameter made up of an adaptive excitation gain and fixed excitation gain, a step of decoding the above-described lag parameter, fixed excitation parameter and gain parameter, and a step of specifying an upper limit of the gain parameter in a normal decoding unit immediately after the decoding unit in which an error is detected.

According to this method, in a normal decoding unit immediately after the decoding unit whose coded data is detected to contain an error, control is performed so as to specify the upper limit of the decoded adaptive excitation gain parameter, thereby making it possible to suppress deterioration of the quality of decoded speech due to an abnormal amplitude expansion of the decoded speech signal in the normal decoding unit immediately after the error detection.

The code error compensation method of the present invention in the above-described method controls the fixed excitation gain so as to maintain a predetermined ratio with respect to the adaptive excitation gain within a range whose upper limit is specified.

According to this method, since the ratio between the adaptive excitation gain and fixed excitation gain is controlled so as to have a value with an original decoding gain without errors, the excitation signal in a normal decoding unit immediately after the error detection becomes more similar to the case with no errors, and it is thereby possible to improve the quality of decoded speech.

The code error compensation method of the present invention comprises a step of receiving data containing coded transmission parameters including a lag parameter and gain parameter, a step of decoding the above-described lag parameter and gain parameter, a step of calculating mode information from a decoding parameter or decoding signal obtained by decoding the above-described data, and a step of using the mode information corresponding to a decoding unit earlier than the decoding unit whose data is detected to contain an error and adaptively determining a lag parameter and gain parameter to be used for the above-described decoding unit.

According to this method, it is possible to adaptively calculate a lag parameter and gain parameter to be used for speech decoding even for the speech coding system whose coding parameter includes no speech mode information according to the mode information calculated on the decoding side, and thereby provide further improved quality for decoded speech.

The recording medium of the present invention is a computer-readable recording medium for storing a program and this program comprises a step of decoding mode information, lag parameter data and gain parameter in data containing coded transmission parameters including the mode information, lag parameter and gain parameter, and a step of using the mode information corresponding to a decoding unit earlier than the decoding unit whose data is detected to contain an error and adaptively determining a lag parameter and gain parameter to be used for the above-described decoding unit.

According to this medium, it is possible to adaptively calculate a lag parameter and gain parameter to be used for speech decoding when speech decoding is performed in the decoding unit whose coded data is detected to contain an error according to the decoded mode information, and thereby provide further improved quality for decoded speech.

The recording medium of the present invention is a computer-readable recording medium for storing a program and this program comprises a step of decoding mode information, lag parameter data and gain parameter in data containing coded transmission parameters including the mode information, lag parameter and gain parameter, and a step of using the mode information corresponding to a decoding unit earlier than the decoding unit whose data is detected to contain an error and controlling the ratio of the adaptive excitation gain to the fixed excitation gain in such a way as to increase the ratio of the adaptive excitation gain when the mode indicated by the above-described mode information is a voiced mode and decrease the ratio of the adaptive excitation gain when the mode indicated by the above-described mode information is a transient mode or unvoiced mode.

According to this medium, when a gain parameter is decoded in the decoding unit whose coded data is detected to contain an error, the ratio of the adaptive excitation gain to the fixed excitation gain is adaptively controlled according to the mode information, making it possible to further perceptually improve the quality of decoded speech in error detection decoding units.

The recording medium of the present invention is a computer-readable recording medium for storing a program and this program comprises a step of decoding a lag parameter and gain parameter in data containing coded transmission parameters including the lag parameter and gain parameter, and a step of specifying an upper limit of the gain parameter in a normal decoding unit immediately after the decoding unit in which an error is detected and controlling the fixed excitation gain so as to maintain a predetermined ratio with respect to the adaptive excitation gain within the range whose upper limit is specified.

According to this medium, it possible to suppress deterioration of the quality of decoded speech due to an abnormal amplitude expansion of the decoded speech signal in the normal decoding unit immediately after the error detection.

As described above, according to the speech decoder and code error compensation method of the present invention, when speech is decoded in a frame whose coded data is detected to contain an error, the lag parameter decoding section and gain parameter decoding section adaptively calculate a lag parameter and gain parameter to be used for speech decoding according to the decoded mode information. This makes it possible to provide further improved quality for decoded speech.

Furthermore, according to the present invention, when a gain parameter is decoded in a frame whose coded data is detected to contain an error, the gain parameter decoding section adaptively controls the ratio of the adaptive excitation gain to the fixed excitation gain according to the mode information. More specifically, by controlling the gain ratio so that the ratio of the adaptive excitation gain is increased when the current frame shows a voiced mode and decreased when the current frame shows a transient or unvoiced mode, it is possible to further perceptually improve the quality of decoded speech of an error detection frame.

Furthermore, according to the present invention, the gain parameter decoding section adaptively controls the adaptive excitation gain parameter and fixed excitation gain parameter to be used for speech decoding according to the value of the decoding gain parameter for a normal frame in which no error is detected immediately after the frame whose coded data is detected to contain an error. More specifically, the gain parameter decoding section controls in such a way as to specify the upper limit of the decoded adaptive excitation gain parameter. This makes it possible to suppress deterioration of the quality of decoded speech due to an abnormal amplitude expansion of the decoded speech signal in the normal frame unit immediately after the error detection. Furthermore, by controlling the ratio of the adaptive excitation gain to the fixed excitation gain so that it becomes the value with the original decoding gain without errors and thereby making the excitation signal in the normal frame after the error detection more similar to the case with no errors, it is possible to improve the quality of decoded speech.

This application is based on the Japanese Patent Application No. HEI 11-185712 filed on Jun. 30, 1999, entire content of which is expressly incorporated by reference herein.

INDUSTRIAL APPLICABILITY

The present invention is applicable to a base station apparatus and communication terminal apparatus in a digital radio communication system. This makes it possible to carry out radio communications resistant to transmission errors.

What is claimed is:

1. A speech decoder comprising:

a decoder that decodes a lag parameter from coded data; and a first detector that detects variations in a lag parameter in a first frame;

a second detector that detects lag parameter variations between the first frame and a second frame; and a determiner that, when an error is detected in the first frame, determines one of the lag parameter in the first frame and a lag parameter in the second frame that is previous to the first frame as an output lag parameter based on detection results in the first detector and the second detector, wherein the determiner determines the lag parameter in the first frame as the output lag parameter, when the variations detected by the first detector are within a predetermined range, and when the variations detected by the first detector are outside the predetermined range and the variations detected by the second detector are within the predetermined range.

2. The speech decoder of claim 1, wherein the determiner determines the lag parameter in the second frame as the output lag parameter when the variations detected by the first detector are outside the predetermined range and the variations detected by the second detector are outside the predetermined range.

3. The speech decoder of claim 1, wherein the determiner determines the output lag parameter when mode information of the second frame indicates one of transient mode and unvoiced mode.

4. The speech decoder of claim 1, wherein the first detector detects variations in a lag parameter based on variations of said lag parameter included in the coded data before decoding.

5. A code error compensation method comprising:

a decoding step of a lag parameter from coded data; and a first detection step of detecting variations in a lag parameter in a first frame;

a second detection of detecting lag parameter variations between the first frame and a second frame; and a determination step of, when an error is detected in the first frame, determining one of the lag parameter in the first frame and a lag parameter in the second frame that is previous to the first frame as an output lag parameter based on detection results in the first detection step and the second detection step, wherein, in the determination step, the lag parameter in the first frame is determined as the output lag parameter, when the variations detected by the first detector are within a predetermined range, and when the variations detected by the first detector are outside the predetermined range and the variations detected by the second detector are within the predetermined range.

* * * * *

UNITED STATES PATENT AND TRADEMARK OFFICE

CERTIFICATE OF CORRECTION

PATENT NO. : 7,171,354 B1
APPLICATION NO. : 10/018317
DATED : January 30, 2009
INVENTOR(S) : Koji Yoshida et al.

It is certified that error appears in the above-identified patent and that said Letters Patent is hereby corrected as shown below:

On the title page: Item (73) naming the Assignee currently reads:

(73) Assignee: Matsushita Electric Industrial Co., Ltd., Osaka (JP)

and should read:

(73) Assignees: Matsushita Electric Industrial Co., Ltd., Osaka (JP)

NEC Corporation, Tokyo (JP)

Signed and Sealed this

Nineteenth Day of October, 2010

David J. Kappos

David J. Kappos
*Director of the United States Patent and Trademark Office*